US006408949B1

(12) United States Patent
Aquilera et al.

(10) Patent No.: US 6,408,949 B1
(45) Date of Patent: Jun. 25, 2002

(54) DEVICE FOR USE FOR MOUNTING AND ALIGNMENT OF A CHRISTMAS TREE ON A WELLHEAD

(75) Inventors: Patrice Aquilera, Hvalstad; Karl-Arne Bertelsen, Kongsberg; Tore Knoph, Bindalseidet, all of (NO)

(73) Assignee: Kongsberg Offshore A/S, Kongsberg (NO)

( * ) Notice: Subject to any disclaimer, the term of this patent is extended or adjusted under 35 U.S.C. 154(b) by 0 days.

(21) Appl. No.: 09/530,646

(22) PCT Filed: Oct. 30, 1998

(86) PCT No.: PCT/NO98/00327

§ 371 (c)(1),
(2), (4) Date: Sep. 5, 2000

(87) PCT Pub. No.: WO99/23351

PCT Pub. Date: May 14, 1999

(30) Foreign Application Priority Data

Nov. 3, 1997 (NO) ..... 19975064

(51) Int. Cl.[7] ..... E21B 33/038; E21B 33/035
(52) U.S. Cl. ..... 166/368; 166/85.5; 166/341
(58) Field of Search ..... 166/368, 341, 166/342, 349, 381, 85.5, 345; 175/7

(56) References Cited

U.S. PATENT DOCUMENTS 3,215,202 A * 11/1965 Pollard et al. ..... 166/341
3,500,906 A * 3/1970 Petersen ..... 166/341
3,513,911 A * 5/1970 Petersen ..... 166/338
3,517,738 A * 6/1970 Petersen ..... 166/349
4,095,649 A * 6/1978 Chateau et al. ..... 166/351
4,169,507 A 10/1979 Szymczak
4,437,521 A 3/1984 Richardson et al.
4,629,003 A 12/1986 Baugh
4,784,224 A * 11/1988 Leach et al. ..... 166/339
4,823,878 A * 4/1989 Brammer et al. ..... 166/341
4,823,879 A * 4/1989 Brammer et al. ..... 166/341
4,877,356 A 10/1989 Bontenbal
4,893,677 A * 1/1990 Brammer et al. ..... 166/341
5,005,650 A 4/1991 Hopper
5,494,110 A 2/1996 Appleford
5,722,796 A 3/1998 Halvorsen et al.
5,868,203 A * 2/1999 Cunningham ..... 166/344

FOREIGN PATENT DOCUMENTS

GB 2069647 A 8/1981

* cited by examiner

*Primary Examiner*—David Bagnell
*Assistant Examiner*—Jennifer H Gay
(74) *Attorney, Agent, or Firm*—Young & Thompson

(57) ABSTRACT

A mounting device for mounting a Christmas tree on a wellhead at sea, for use during a lowering of the Christmas tree from a platform to a drilling template which is located on the seabed. The mounting device includes an adaptor with end sections for connection with respective sections of the drilling template and the Christmas tree. The end sections of the adaptor have alignment bodies which are arranged for engagement with coacting alignment bodies of the drilling template and the Christmas tree.

2 Claims, 1 Drawing Sheet

DEVICE FOR USE FOR MOUNTING AND ALIGNMENT OF A CHRISTMAS TREE ON A WELLHEAD

BACKGROUND OF THE INVENTION

The invention concerns a device used for mounting and alignment of a Christmas tree which can be lowered from a platform to a wellhead which is located on a seabed. The Christmas tree has a funnel which is widened downwardly, orientation bodies for angular positioning of the Christmas tree relative to the wellhead, and connection bodies for connecting the Christmas tree to the wellhead. The device comprises a side element of a drilling template, which has a guiding device which is arranged to receive a guide pipe, the guiding device comprises a conical funnel, and the guide pipe is arranged to receive the wellhead and comprises a cylindrical adaptor.

From the prior art it is known that when mounting a Christmas tree on a wellhead, guidelines are employed which extend from the platform to the drilling template, the guidelines being connected at the bottom to guide posts on to which sleeves of the Christmas tree are passed, and which provide a precise alignment of the Christmas tree in a horizontal plane relative to the drilling template.

The use of guide lines and a drilling template is described for instance in GB 2 285 274 which discloses a drilling template comprising a central part and arms that may be swung outwardly. Each of the arms is arranged above a well and a manifold is mounted at the central part. The well and the manifold are interconnected through pipes.

Each well is completed by firstly introducing a drill string through an arm. and boring a hole into the formation underneath the arm. Thereafter a guide pipe or conductor is introduced into the hole and cemented there whereby it is able to carry heavy equipment. The top of the guide pipe is welded to a guide pipe housing which comprises outer orientation elements such as pegs, which are adapted to be introduced into corresponding slots in the arm. A guide base or plate is fixed to the guide pipe housing. During the lowering of the guide pipe/plate assembly through the opening in the arm the orientation elements are providing a rotation of the assembly until its position is correct with respect to the central part of the drilling template.

Guide posts wherefrom guide lines are running to a platform at the sea surface are provided at the base or plate.

The guide pipe housing is provided with internal steps in such a way that it may support casings which are introduced into the well.

When a Christmas tree is to be mounted at the well, it is lowered and guided by means of the guide lines in such a way that the Christmas tree is oriented correctly with respect to the manifold at the central part of the drilling template. This is very important because the Christmas tree and the manifold have pipe connector parts which shall be interconnected during the lowering of the Christmas tree, and the tolerance with respect to the mutual angular orientation of the Christmas tree and the manifold is small.

The use of guide lines for drilling templates at very large depths is difficult because the guide lines become tangled up. It is also difficult to keep the guide lines tensioned sufficiently.

In the case of drilling templates which are employed at very great depths where no guidelines extend therefrom to the platform, there are difficulties involved in such an alignment.

SUMMARY OF THE INVENTION

The object of the invention is to provide a mounting device of the type mentioned in the introduction which enables the above-mentioned alignment to be implemented.

The characteristics of the mounting device according to the invention are presented in the characteristic features indicated in the claims.

BRIEF DESCRIPTION OF THE DRAWINGS

The invention will now be described in more detail with reference to the drawing which schematically illustrates an embodiment of the mounting device according to the invention.

FIG. 2 is a side view of a mounting device according to the invention, which is fitted in a receiving section of a wing element of a drilling template, this section being cut through.

DESCRIPTION OF THE PREFERRED EMBODIMENTS

Figure 1:
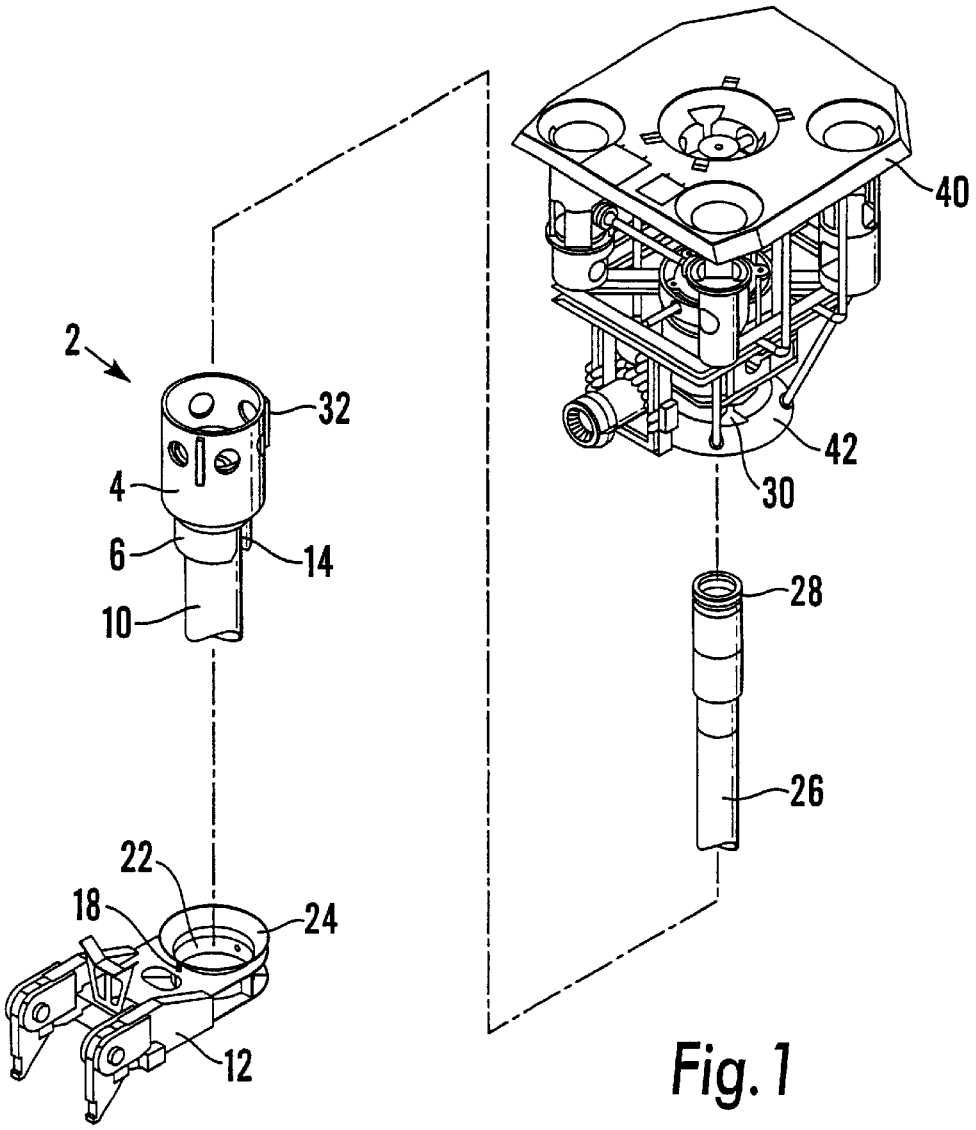
FIG. 1 is a perspective view of a component of a Christmas tree which is mounted on a wing element of a drilling template using the mounting device according to the invention, these components being separated from one another.

With reference to the drawing the direction indication "up" should hereinafter be understood as the direction towards the edge of the drawing facing away from the reader.

Figure 2:
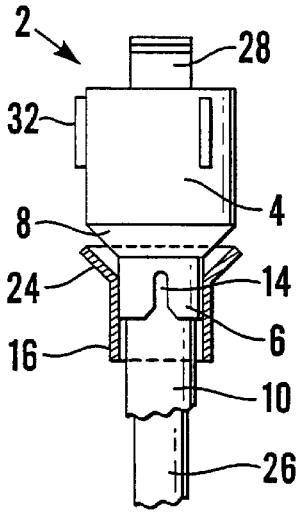

As illustrated in FIG. 1 an adaptor 2 comprises an upper cylindrical pipe section 4 and a lower cylindrical pipe section 6 which are interconnected via a conical pipe section 8 as is better illustrated in FIG. 2. The lower pipe section 6 is securely connected to the upper section of a guide pipe 10 with an outer diameter of, e.g., 30" (762 mm) which extends down into the well (not shown) and through a receiving section 22 of a side or wing element 12 which is hinged to a central section of a drilling template (not shown).

An orientation or alignment of the adaptor 2 in relation to the side element 12 can be achieved by means of notches 14 which are provided in the lower pipe section 6 of the adaptor 2, and which are arranged to receive corresponding lugs 18 of a cylindrical section 16 of the receiving section 22 of the side element 12. This engagement is achieved by means of a suitable rotation of the adaptor relative to the side element when they are brought into engagement during a lowering of the adaptor 2 from the platform and insertion of the adaptor 2 in the receiving section 22. A conical funnel section 24 of the receiving section 22 facilitates this insertion which is controlled by a remotely operated subsea vessel.

Through the guide pipe 10 there extends a casing 26 with an outer diameter of, e.g., 20" (508 mm), the top of which is securely connected to a wellhead 28. This guide pipe is cemented to the casing 26.

In the upper pipe section 4 of the adaptor 2 there is provided at least one lug or rib 32 which projects radially outwards.

A Christmas tree 40 has at the bottom a downwardly open entry funnel 42 which is widened downwards, and which at the top changes into a cylindrical tubular section (not shown) with an inner diameter which is slightly larger than the outer diameter of the upper pipe section 4 of the adaptor 2. This tubular section of the Christmas tree 40 is provided with a downwardly open guide groove 30 which is adapted to the lug 32 of the adaptor.

When the Christmas tree 40 is lowered towards the wellhead 28 so that the wellhead 28 is first passed into the entry funnel 42 and then into the tubular section of the Christmas tree 40, during which the lugs and the guide grooves of the Christmas tree and the adaptor respectively come into engagement with each other, the object can be achieved that the Christmas tree and the adaptor are first aligned in such a manner that the tubular section of the Christmas tree 40 and the upper pipe section of the adaptor extend mutually coaxially, whereupon these sections are aligned or oriented in relation to each other in a horizontal plane and secured in the aligned position. By this means contact surfaces of the Christmas tree and the wellhead can finally come into engagement, thus giving support to the Christmas tree.

What is claimed is:

1. A device for mounting and aligning a Christmas tree (40) which can be lowered from a platform on a wellhead (28) located on a seabed, said device comprising:

a side element (12) mountable on a drilling template;

a guide pipe (10) arranged to receive the wellhead, the side element (12) having a guiding device comprising a conical funnel (24) to receive the guide pipe; and a substantially cylindrical adaptor (2), wherein the adaptor comprises a lower section (6) with alignment and orientation bodies (14) which are arranged to coact with bodies (18) of the side element (12), a truncated cone-shaped intermediate section (8) which is adapted to the shape of the funnel (24) of the side element, and an upper section (4), which has an outer diameter which is larger than the outer diameter of the lower section (6) and is adapted for insertion in a funnel (42) of the Christmas tree (40), and which has alignment and orientation bodies (32) adapted for coacting with corresponding orientation bodies (30) of the Christmas tree (40).

2. A mounting device according to claim 1, characterized in that the alignment bodies comprise lugs (18, 32) and notches (14, 30).

* * * * *